US007287741B2

(12) United States Patent
Horikawa et al.

(10) Patent No.: US 7,287,741 B2
(45) Date of Patent: Oct. 30, 2007

(54) ROTARY THROTTLE VALVE CARBURETOR

(75) Inventors: Takashi Horikawa, Natori (JP); Teruhiko Tobinai, Sendai (JP); Susumu Takezawa, Ohgawara-Machi (JP); Jun Takano, Ohgawara-Machi (JP)

(73) Assignee: Walbro Japan, Inc., Tokyo (JP)

( * ) Notice: Subject to any disclaimer, the term of this patent is extended or adjusted under 35 U.S.C. 154(b) by 300 days.

(21) Appl. No.: 11/029,716

(22) Filed: Jan. 5, 2005

(65) Prior Publication Data

US 2005/0173814 A1 Aug. 11, 2005

(30) Foreign Application Priority Data

Feb. 9, 2004 (JP) ..... 2004-031692
Mar. 9, 2004 (JP) ..... 2004-065293

(51) Int. Cl.
*F02M 9/08* (2006.01)

(52) U.S. Cl. ..... 261/44.6; 29/890.12; 261/44.8

(58) Field of Classification Search ..... 261/44.6–44.8; 29/890.12

See application file for complete search history.

(56) References Cited

U.S. PATENT DOCUMENTS 1,044,569 A * 11/1912 Perrin ..... 261/44.6
1,782,848 A * 11/1930 Gravely ..... 261/44.8
4,481,152 A * 11/1984 Kobayashi et al. ..... 261/35
4,481,153 A * 11/1984 Kobayashi et al. ..... 261/44.2
4,946,631 A * 8/1990 Buford ..... 261/39.5
5,599,484 A * 2/1997 Tobinai ..... 261/44.2
5,709,822 A 1/1998 Togashi ..... 261/44.2
6,378,846 B1 * 4/2002 Terakado et al. ..... 261/44.8
6,382,599 B1 * 5/2002 Aihara et al. ..... 261/37
6,394,424 B2 * 5/2002 Pattullo et al. ..... 261/35
6,394,425 B1 * 5/2002 Nagata ..... 261/44.8
6,662,767 B1 * 12/2003 Nonaka ..... 123/73 A
6,827,338 B2 * 12/2004 Nonaka ..... 261/44.3
2003/0111743 A1 * 6/2003 Ohgane et al. ..... 261/44.8

FOREIGN PATENT DOCUMENTS

JP 3-50367 A * 3/1991 ..... 261/44.8

* cited by examiner

*Primary Examiner*—Richard L. Chiesa
(74) *Attorney, Agent, or Firm*—Reising, Ethington, Barnes, Kisselle, P.C.

(57) ABSTRACT

A rotary throttle valve carburetor includes a main body defining a mixing passage and a valve bore, and a throttle valve rotatably received in the valve bore to selectively open and close the mixing passage. The carburetor main body includes an integral throttle valve support extending radially inwardly relative to the valve bore adjacent to a first end of the valve bore and a second end of the valve bore is open. A throttle cable retaining portion may also be integrally formed with the carburetor main body.

20 Claims, 5 Drawing Sheets

ROTARY THROTTLE VALVE CARBURETOR

REFERENCE TO RELATED APPLICATION

Applicant claims priority of Japanese patent applications, Serial Nos. JP 2004-031692, filed Feb. 9, 2004 and JP 2004-065293, filed Mar. 9, 2004.

1. Field of the Invention

This invention relates generally to a carburetor and more particularly to throttle valve arrangement in a rotary throttle valve carburetor.

2. Background of the Invention

A conventional rotary throttle valve carburetor for use in small internal combustion engines such as lawn mowers, motor scooters and the like comprises a cylindrical rotary throttle valve with a valve passage that is selectively and variably registered with a mixing passage of the carburetor by rotating the throttle valve about an axis generally perpendicular to the mixing passage. A needle valve extends into the passage of the rotary valve, and a fuel nozzle projects into the mixing passage and slidably receives the tip of the needle valve.

In such a rotary throttle valve carburetor, a valve bore rotatably receives the throttle valve and is formed by casting at the same time as casting the carburetor main body by removing a core or a die component to form a completely open upper end of the valve bore and a generally planar lower wall of the valve bore through which an opening is provided to receive the fuel nozzle. After casting, the valve bore is finished by machining for rotatably receiving the throttle valve. The open upper end of the valve bore is closed by a lid, and the lid defines a bearing portion for journaling a shaft projecting from the throttle valve. An actuation lever is attached to the end of the throttle valve shaft, and is connected to an external throttle lever via a wire or the like.

The throttle valve is journalled both by the valve bore provided in the carburetor main body and the bearing portion provided in the lid. Because the carburetor main body and lid are manufactured and finished separately, it is necessary to join them together so that an opening in the lid that receives the throttle valve shaft is accurately coaxially aligned with the valve bore, and this requires a relatively high level of manufacturing technology and effort.

To actuate the throttle valve, a lever is connected to the throttle valve and to a cable. The cable usually has an inner cable slidably received in an outer sheath, with the inner cable attached to the throttle valve lever by a swivel carried by the lever. The outer sheath is connected by a lock nut to a cable retaining portion of the lid carried by the carburetor body. So the position of the lid relative to the carburetor body controls the position of the inner cable relative to the throttle valve by way of the connection of the outer sheath to the lid. When the throttle valve is rotated, the end of the inner cable at the swivel moves along an arcuate path, the precision of which is also controlled by the position of the lid relative to the throttle valve including the throttle valve lever. Some tolerance is required in the position of the lid on the carburetor body to facilitate manufacture and assembly of the carburetor, and this affects their relative position from one carburetor to another.

SUMMARY OF THE INVENTION

A carburetor with a main body having a mixing passage and a transverse valve bore which at one end opens through the main body and adjacent the other end has an integral valve support extending radially inwardly of the valve bore.

A throttle valve with a valve passage is rotatably received in the valve bore to selectively open and close the mixing passage and has a co-axial actuator shaft projecting through a bore in the integral valve support of the main body. Preferably, a throttle cable retainer is integrally formed on the main body adjacent the valve support portion.

With the valve bore for rotatably receiving the throttle valve body and the throttle valve support both formed in the carburetor main body, the desired position and alignment of these two components can be easily controlled and repeatedly achieved, for instance by casting. Because a separate lid is not required, the number of necessary component parts and the amount of the assembly work can be reduced so that assembly is simplified and the manufacturing cost is reduced. Also, because a lid is not required with the carburetor, a cable retaining portion adapted to retain an outer sheath of a throttle cable can be integrally formed on the carburetor body. This facilitates accurate and repeatable positioning of the cable retaining portion relative to the throttle valve, and thereby facilitates assembly, manufacture and consistent operation of the throttle valve assembly.

BRIEF DESCRIPTION OF THE DRAWINGS

These and other objects, features and advantages of the present invention will be apparent from the following detailed description of the preferred embodiments and best mode, appended claims and accompanying drawings in which:

DETAILED DESCRIPTION OF THE PREFERRED EMBODIMENTS

Figure 1:
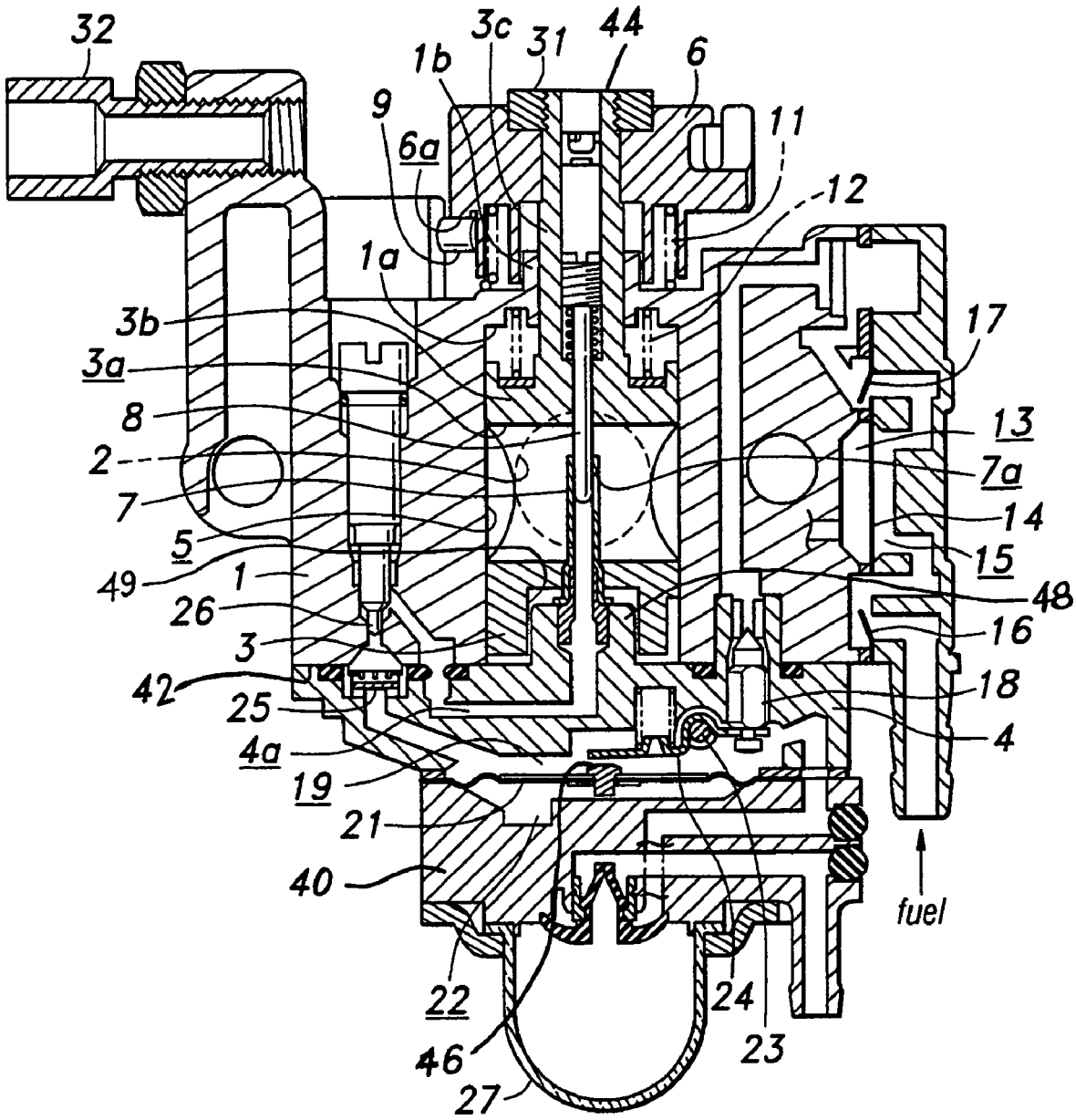
FIG. 1 is a sectional side view of a rotary throttle valve carburetor according to one presently preferred embodiment of the invention.

Referring in more detail to the drawings, FIG. 1 illustrates a rotary throttle valve carburetor that includes a carburetor main body 1 provided with a fuel and air mixing passage 2. Air enters the mixing passage 2 at one end, is mixed with fuel, and a fuel and air mixture flows out of an outlet end of the mixing passage 2 for delivery to an engine. The main body 1 also includes a valve bore 5 extending perpendicular to and communicated with the mixing passage 2. A rotary throttle valve 3 is placed in the valve bore 5 and includes an intake or valve passage 3*a* therethrough that is variably aligned or registered with the mixing passage 2 to selectively open and close the same. The main body 1 preferably is formed of cast metal, such as diecast aluminum, or by other suitable methods and materials known in the art.

A second carburetor body, such as a fuel chamber body 4, is attached to the lower end of the carburetor main body 1. A pump body 40 is attached to the fuel chamber body 4 and a priming pump 27 is attached to the lower surface of the pump body 40. The valve bore 5 opens out from the surface 42 of the carburetor main body 1 to which the fuel chamber body 4 is attached and preferably is essentially unrestricted or unobstructed in that area. In assembly, the fuel chamber body 4 at least partially closes or obstructs the open end of the valve bore 5.

The throttle valve 3 includes a throttle valve body 3*b* rotatably received in the valve bore 5 and formed with an intake or valve passage 3*a*. The valve body 3*b* can move between an idle position and a fully or wide open position with respect to the mixing passage 2 in accordance with the angular position of the throttle valve body 3*b*. A throttle valve shaft 3*c* coaxially and preferably integrally extends from the throttle valve body 3*b* and at least a portion of the valve shaft 3*c* extends out of the carburetor main body 1. The carburetor main body 1 is provided with an upper wall 1*a* that defines part of the valve bore 5. The upper wall 1*a* is provided with a support or bearing portion 1*b* having a through bore defining a cylindrical bearing surface for journaling the valve shaft 3 coaxially with respect to the valve bore 5. Thus, the throttle valve 3 is journalled by both the valve bore 5 and support 1*b* in the carburetor main body 1.

The end 44 of the valve shaft 3*c* that extends out of the carburetor main body 1 is connected to a throttle valve lever 6 such as by a threaded nut 31, for example. The free end of the throttle valve lever 6 is connected to an end of a throttle cable (not shown) and a cable retaining portion 32 for fixedly retaining a sheath of the throttle cable is provided on the carburetor main body 1.

The fuel chamber body 4 is provided with a projection 48 or a boss portion which projects into the carburetor main body 1, and a tubular fuel nozzle 7 projects from the boss portion into the throttle valve 3. The throttle valve 3 is provided with an intake or valve passage 3*a* extending perpendicularly with respect to the rotational axis of the throttle valve. FIG. 1 illustrates the throttle valve 3 in its idle position wherein the throttle valve 3 closes the mixing passage 2. The throttle valve 3 further preferably has a recess 49 that receives the boss portion 48 of the fuel chamber body 4 to rotatably journal and locate that end of the throttle valve 3. Of course, the fuel chamber body 4 could have a recess in which a projection from the throttle valve 3 could be received.

An intermediate portion of the fuel nozzle 7 is provided with a fuel ejection orifice 7*a* opening into and generally axially with respect to the valve passage 3*a* and a fuel metering needle valve 8 is carried by the throttle valve 3 and projects into the fuel nozzle 7 from the upper open end thereof. The throttle valve shaft 3*c* is provided with an axial bore and a counterbore into which the fuel metering needle valve 8 is received. The counterbore is preferably threaded and a base of the fuel metering needle valve 8 is threadedly received therein.

A free end of the needle valve 8 extends into the fuel nozzle 7 and in at least some throttle valve positions restricts fluid flow through the fuel ejection orifice 7*a*. The base of the needle valve 8 is resiliently urged by a compression coil spring in the direction tending to move it out of the counterbore to maintain the needle valve in position. Therefore, by axially moving the needle valve 8 in the counterbore, the initial position of the needle valve 8 with respect to the fuel ejection orifice 7*a* can be adjusted.

The lower open end of the fuel nozzle 7 communicates with a fuel passage 4*a* provided in the fuel chamber body 4 so that fuel fed from the fuel passage 4*a* rises in the fuel nozzle 7 and is expelled form the fuel ejection orifice 7*a* into the valve passage 3*a* as a result of the negative pressure existing in the valve passage 3*a*. The fuel flow rate can be adjusted by changing the position of the needle valve 8 with respect to the fuel ejection orifice 7*a*.

The axial length of the valve bore 5 is greater than that of the throttle valve main body 3*b* of the throttle valve 3. This accommodates axial movement of the throttle valve 3 which is controlled by a cam assembly. In more detail, the lower surface of the throttle valve lever 6 facing the carburetor main body 1 is formed with or carries a cam surface 6*a*, and a corresponding cam follower 9 is carried by the carburetor main body 1. The cam surface 6*a* is provided with a cam profile adapted to axially move the throttle valve 3 as the throttle valve is rotated.

To yieldably rotatably bias the throttle valve toward its idle position, a torsion coil spring 11 is positioned between the throttle valve lever 6 and carburetor main body 1 and is coaxially wound around the throttle shaft 3*c*. To yieldably axially bias the throttle valve 3 toward the fuel chamber body 4, a compression coil spring 12 preferably is interposed between the upper surface of the valve bore 5 and the opposing upper surface of the throttle valve 3. As a result, the throttle valve lever 6 is also axially biased toward the cam follower 9 so that the cam surface 6*a* is kept in contact with the cam follower 9.

The carburetor is provided with a pump diaphragm 14 that on one side defines part of a pressure chamber 13 that communicates with the crankcase to receive pulsating pressure therefrom, and on its other side defines part of a pump chamber 15. The pump chamber 15 communicates with a fuel tank (not shown) via a passage formed in the carburetor main body and an inlet check valve 16, and with a fuel metering chamber 19 via an outlet check valve 17 and a fuel flow control valve 18. As the pump diaphragm 14 reciprocates under a pulsating pressure signal, the fuel in the fuel tank is drawn into the pump chamber 15, through the inlet check valve 16. The pump diaphragm 14 then forces fuel out of the pump chamber 15 through the outlet check valve 17 and into the fuel metering chamber 19 when the control valve 18 is open.

A fuel metering diaphragm 21 is interposed between the fuel chamber body 4 and the pump body 40, and a part of the fuel metering chamber 19 is defined by the diaphragm 21. The other side of the diaphragm 21 defines part of an atmospheric chamber 22. A lever 24 is pivotally supported by a pivot shaft 23 provided in a suitable part of the fuel metering chamber 19. One end of the lever 24 is connected to the fuel flow control valve 18, and the other end of the lever 24 opposes a central projection 46 of the diaphragm 21. As the diaphragm 21 deflects, the central projection 46 moves in the axial direction and pushes the other end of the lever 24 with the result that the lever 24 rotates in the clockwise direction (as viewed in FIG. 1), and opens the fuel flow control valve 18. The lever 24 is resiliently urged, such as by a spring, in the direction to close the fuel flow control valve 18.

From the fuel metering chamber 19, fuel flows into the fuel passage 4*a* defined in the fuel chamber body 4 via a check valve 25 provided between the fuel metering chamber 19 and carburetor main body 1 and a fuel jet 26 provided in the carburetor main body 1, and then to the fuel nozzle 7. As discussed earlier, the fuel flow rate from the fuel orifice 7*a* is adjusted by the fuel metering needle valve 8 which moves axially with the throttle valve 3.

In use, the throttle valve lever 6 connected to the throttle cable is angularly moved so that the throttle valve 3 rotates about its axis to open and close the mixing passage 2. The angular movement of the throttle valve lever 6 also causes an axial movement of the throttle valve 3 by way of the sliding engagement between the cam follower 9 and cam surface 6*a* to adjust the effective flow area of the fuel nozzle orifice 7*a*.

To ensure smooth operation of the throttle valve, the part retaining the throttle valve body 3*b* of the throttle valve 3 and the part rotatably supporting the throttle valve shaft 3*c* preferably are accurately coaxially aligned with respect to each other. In the illustrated embodiment, the part retaining the throttle valve body 3*b* of the throttle valve 3 consists of the valve bore 5, and the part rotatably supporting the throttle valve shaft 3*c* consists of the bearing and support 1*b*. Preferably, the bearing and support portion 1*b* can be integrally formed with the carburetor main body 1. When cast or molded, a core can be used to form the coaxially aligned valve bore 5 and bearing and support 1*b* with the end of the valve bore 5 opposite the bearing and support portion being open so the core can be removed. The cast or molded holes and structures may be finished by machining so as to define the valve bore 5 and support 1*b*.

Figure 2:
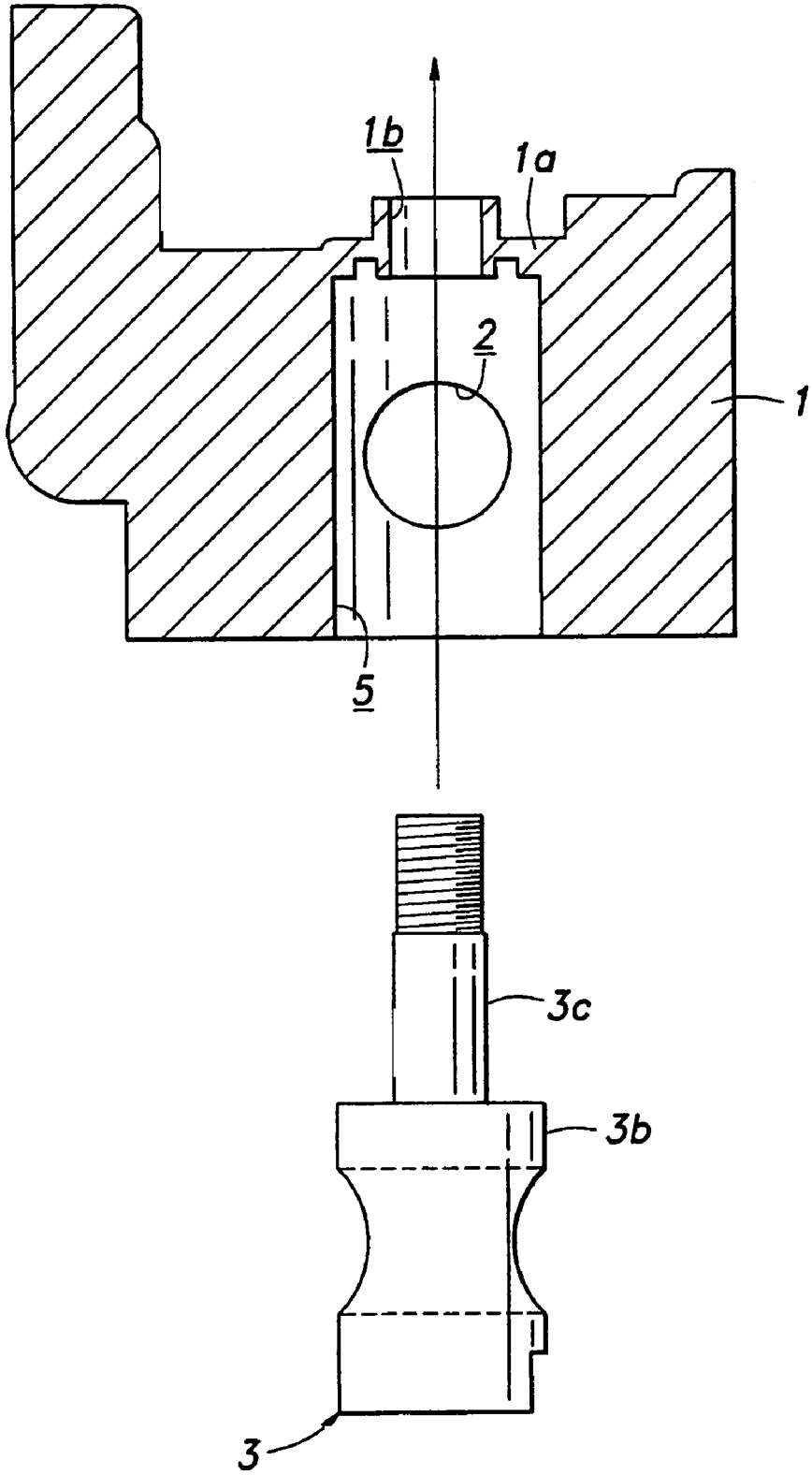
FIG. 2 is an exploded view showing the mode of assembling the throttle valve into a carburetor main body.

In this manner, the valve bore 5 and support 1*b* can be formed coaxially to each other both easily and precisely. After the valve bore 5 and support 1*b* are formed in the carburetor main body 1, the throttle valve 3 is inserted in the valve bore 5 from the open end thereof as illustrated in FIG. 2. Then the fuel chamber body is fixed to the main body 1 to retain the throttle valve 3 in the valve bore 5. Thus, even though a lid is not used, the assembly operation can be easily accomplished.

When a lid is used to enclose the valve bore and rotatably and axially journal the throttle valve shaft it is difficult to achieve the desired level of accuracy in the coaxial alignment of a bore in the lid with the valve bore. On the other hand, when the valve bore 5 and support 1*b* are both integrally and simultaneously formed in the carburetor main body 1, the centering and alignment can be accomplished easily and reliably. Because of the elimination of the need for a lid, the assembly work is simplified and the manufacturing cost can be reduced owing to the reduction in the amount of assembly work and number of necessary component parts.

Figure 3:
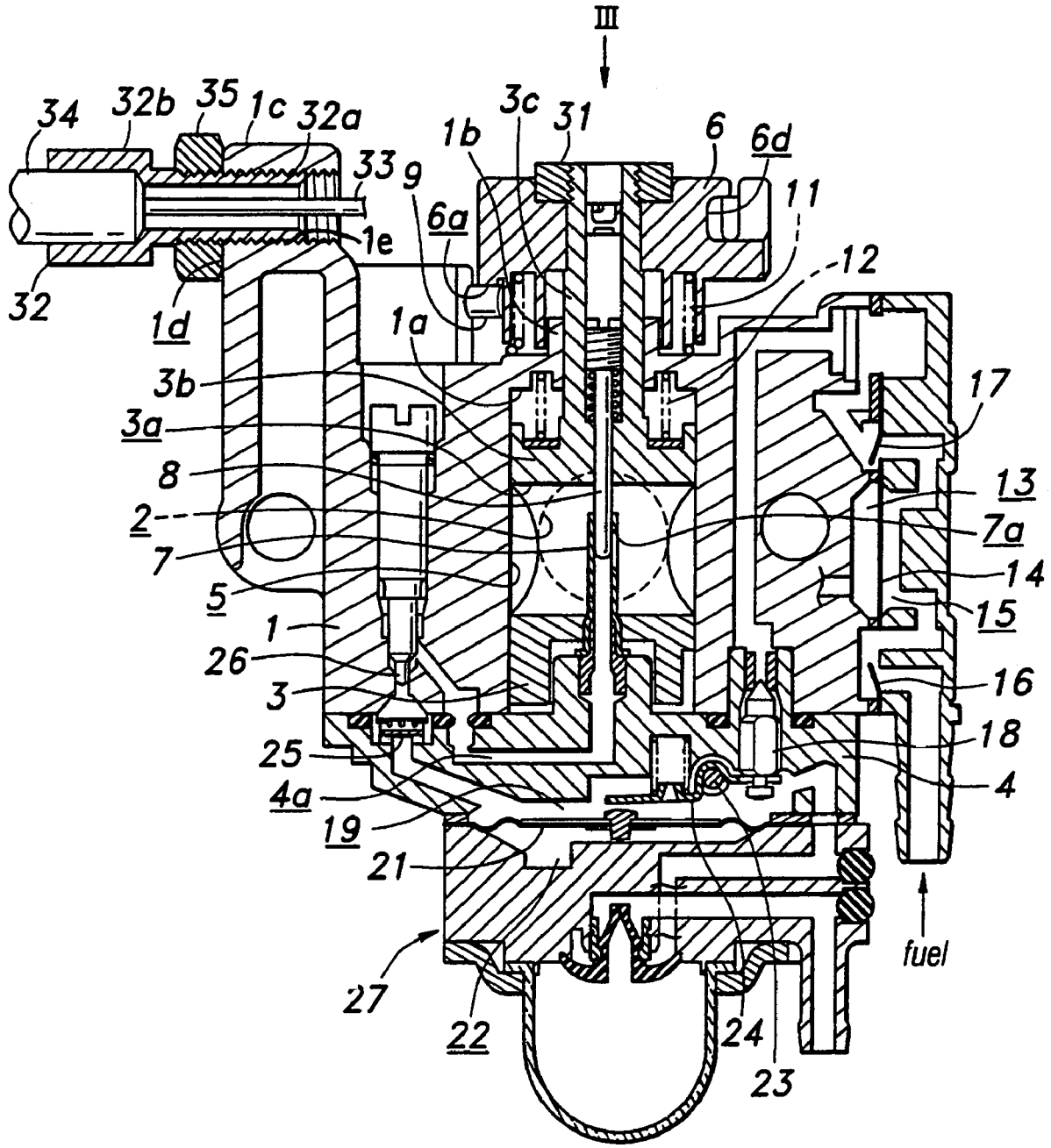
FIG. 3 is a sectional side view of a rotary throttle valve carburetor with a throttle cable retaining arrangement according to one presently preferred embodiment of the invention.

As shown in FIG. 3, the throttle valve lever 6 is connected to an end of a throttle cable. The throttle cable includes an inner cable 33 connected to the free end of the throttle valve lever 6 and an outer sheath 34 supporting the inner cable 33 in an axially slidable manner.

The upper surface of the carburetor main body 1 is integrally formed with a cable retaining portion 1*c* projecting therefrom adjacent to the actuation never 6. A cable retainer 32 is fixedly secured to the cable retaining portion 1*c*. The cable retainer 32 preferably comprises a threaded portion 32*a* received in a threaded bore 1*e* formed in the cable retaining portion 1*c* and an enlarged cylindrical portion 32*b* receiving and retaining an end of the outer sheath 34. An adjustment nut 35 serving as a lock nut threads onto part of the threaded portion 32*a* exposed from the cable retaining portion 1*c* so that the position of the retained end of the outer sheath 34 may be adjusted with respect to the cable retaining portion 1*c*. As discussed with regard to FIGS. 1 and 2, no lid is needed to close the throttle valve bore 3 so the cable retaining portion 1*c* can be integrally formed with the carburetor main body 1.

Figure 4:
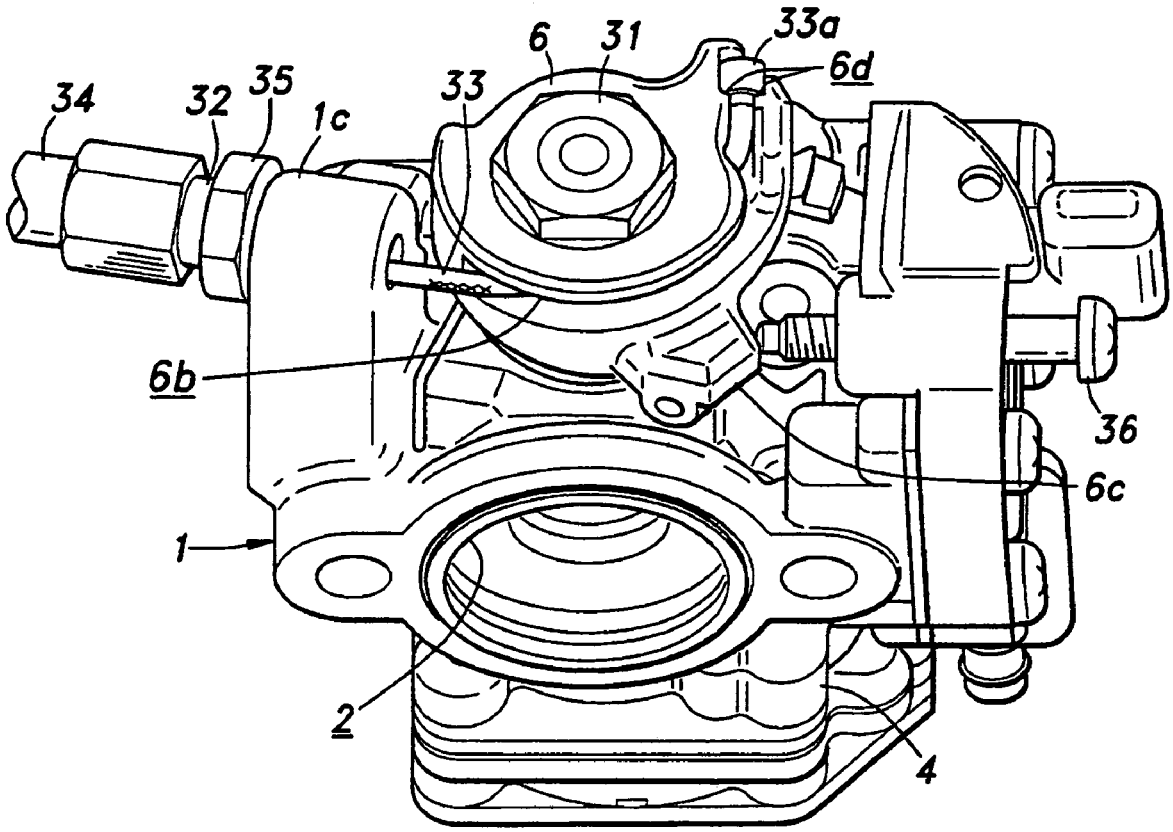
FIG. 4 is a perspective view of the rotary throttle valve carburetor of FIG. 3.

As best shown in FIG. 4, the idle position of the throttle valve is determined by engagement of an idle adjustment screw 36 with a stop surface 6*c* on the throttle valve lever 6. The idle position can be adjusted by advancing or retracting the adjustment screw 36 relative to the carburetor main body 1.

Figure 5:
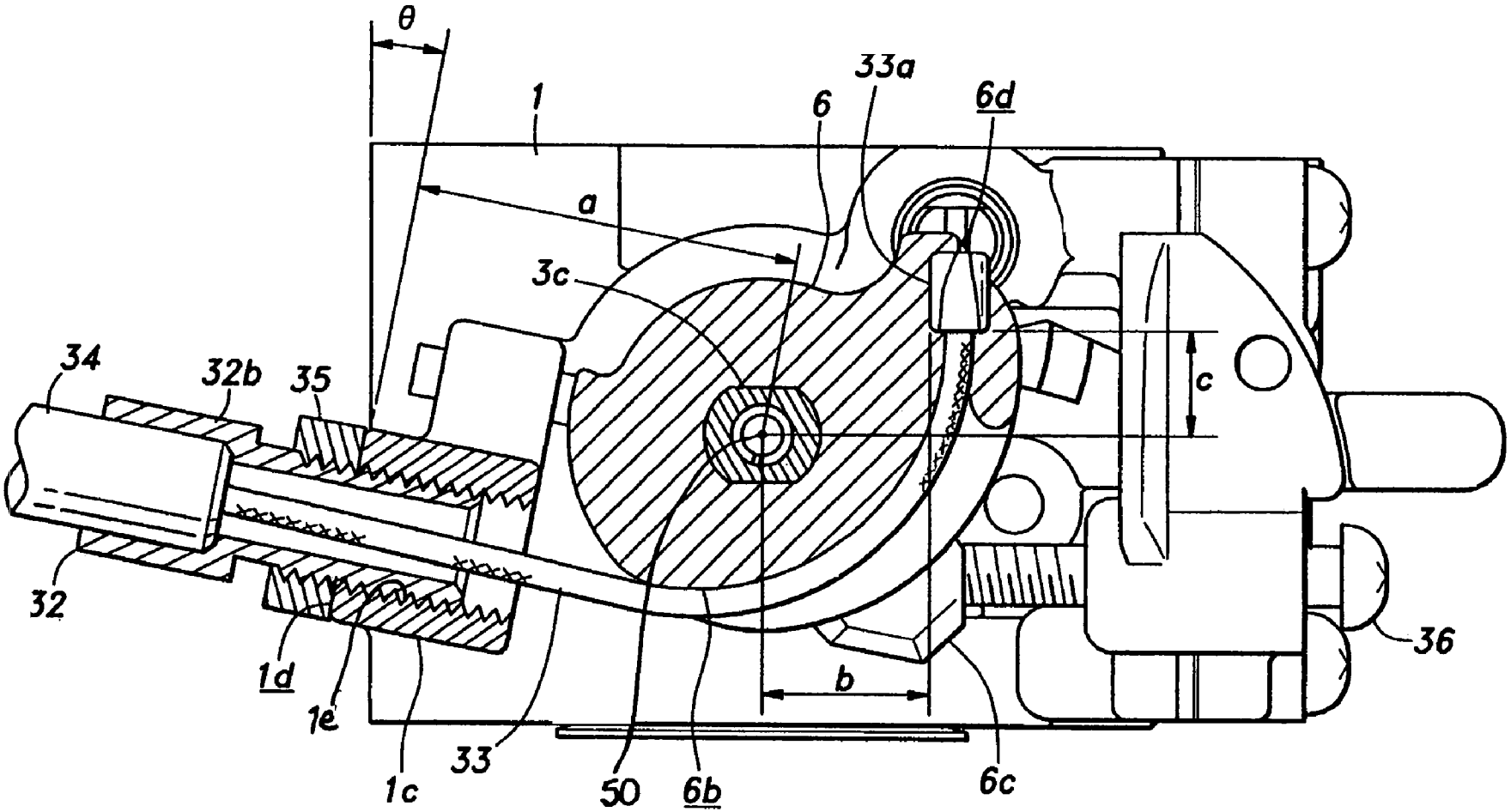
FIG. 5 is a plan view partly in section taken along line 3-3 of FIG. 3.

As shown in FIG. 5, an engagement recess 6*d* is formed on a peripheral end portion of the throttle valve lever 6 to engage a cylindrical cable end 33*a* fitted on the corresponding end of the inner cable 33 against the tension acting upon the inner cable 33. The throttle valve lever 6 is also provided with a circumferential groove 6*b* extending along a peripheral part thereof in continuation from the engagement recess 6*d*. The circumferential groove 6*b* may have a U-shaped cross-section that opens in a radially outward direction along a part of the peripheral part of the throttle valve lever 6. A portion of the cable is entrained in the groove 6*b* during at least a portion of the movement of the throttle valve lever 6.

In this carburetor, as shown in FIG. 5, the engagement surface 1*d* of the cable retaining portion 1*c* that engages the adjustment nut 35 may be referenced for positioning to the axial center of the throttle valve 3 or the center of the throttle valve shaft 3*c*, and the distance "a" between the axial center of the throttle valve 3 and engagement surface 1*d* and the inclination angle θ of the outer sheath 34 with respect to the axial center line may be used to determine the positional precision or accuracy between the axial center of the throttle valve 3 and cable retaining portion 1*c*. As discussed earlier, because the cable retaining portion 1*c* is integrally formed with the carburetor main body 1 which supports the throttle valve 3, the precision in the positional relationship between the axial center of the throttle valve 3 and cable retaining portion 1*c* can be relatively easily ensured.

The positional accuracy of the engagement recess 6*d* that engages the cable end 33*a* of the inner cable 33 is determined by the accuracy in the distance "b" and "c" from the axial center along the X and Y axes in FIG. 5 using the axis 50 of the throttle valve 3 as a point of reference. In this case also, because the reference point for the dimensions "b" and "c" is the axis 50 of the throttle valve 3, the position of the engagement recess 6*d* is determined directly with respect to the carburetor main body 1, without involving the intervention of a lid or the like as in the prior art, and the positional precision of the engagement recess 6*d* with respect to the throttle valve 3 can be ensured without difficulty.

The positional precision of the throttle valve lever 6 with respect to the throttle valve shaft 3*c* is determined by the precision in the machining of the flattened surfaces of the throttle valve shaft 3*c* for mounting the throttle valve lever 6 thereon for conjoint rotation. Because these surfaces are formed on the throttle valve shaft 3*c* that is integral with the throttle valve 3, a highly precise machining of these surfaces is possible.

The adjustment screw 36 is installed in the carburetor main body 1 in such a manner that the adjustment screw 36 abuts a stop surface 6*c* formed in the throttle valve lever 6 in the direction opposing the cable retaining portion 1*c*. Therefore, in the fully closed state, the adjustment screw 36 and stop surface 6*c* are both located on an extension of the axis of the outer sheath 34, and the precision of the stop surface 6*c* with respect to the cable retaining portion 1*c* can be ensured in a similar fashion.

In the foregoing embodiment, the throttle valve lever 6 was provided with a circumferential groove 6*b* for receiving the inner cable 33 that is passed around the throttle valve lever 6, but the present invention is not limited by or to this embodiment. For instance, the present invention is equally applicable to, by way of example without limitation, a case where the actuation lever is fitted with a swivel to connect an end of the inner cable thereto.

The invention claimed is:

1. A rotary throttle valve carburetor, comprising:

a main body having a mixing passage, a valve bore communicating with the mixing passage and having an open end, and a support portion formed integrally with the main body and at least partially obstructing a portion of the valve bore spaced from said open end; and a throttle valve having a body with a valve passage therein and a throttle valve shaft extending from the body adjacent to the support portion and out of an end of the valve bore opposite the open end, the throttle valve body being disposed in the valve bore for rotation about an axis extending generally perpendicular to the mixing passage to selectively register the valve passage with the mixing passage and thereby selectively open and close the mixing passage.

2. The carburetor of claim 1 wherein the valve bore and support portion are formed simultaneously when forming the carburetor main body by using a die assembly.

3. The carburetor of claim 1 wherein the support portion includes a through bore through which the throttle valve shaft extends.

4. The carburetor of claim 3 wherein the valve bore and the through bore are coaxially aligned.

5. The carburetor of claim 1 wherein the support portion is disposed adjacent to the end of the valve bore opposite the open end.

6. The carburetor of claim 1 which also comprises a throttle valve lever coupled to an end of the throttle valve shaft that extends out of the valve bore.

7. The carburetor of claim 1 which also includes a second carburetor body attached to the main body and at least partially obstructing the open end of the valve bore to retain the throttle valve within the valve bore in assembly.

8. The carburetor of claim 7 wherein the second carburetor body includes one of a projection and a recess and the throttle valve includes the other of the projection and recess with these components cooperating to rotatably journal the end of the throttle valve adjacent to the second carburetor body.

9. The carburetor of claim 1 wherein the support portion defines an upper wall of the valve bore and includes a through bore, and the throttle valve shaft extends through said through bore.

10. A rotary throttle valve carburetor, comprising:

a main body having a mixing passage, a valve bore communicating with the mixing passage, and a cable retaining portion formed integrally with the main body and constructed to receive a portion of a throttle cable; and a throttle valve having a body disposed in the valve bore for rotation about an axis extending generally perpendicular to the mixing passage to selectively register a valve passage with the mixing passage and thereby selectively open and close the mixing passage, a throttle valve shaft extending from the body and out of an end of the valve bore, and a throttle valve lever carried by the throttle valve shaft and adapted for coupling to a portion of a throttle cable that is used to displace the throttle valve.

11. The carburetor of claim 10 wherein the cable retaining portion is constructed to retain an outer sheath of the throttle cable and the throttle valve lever is constructed to be connected to an inner cable of the throttle cable that is movable relative to the outer sheath.

12. The carburetor of claim 10 which also comprises a cable retainer carried by the cable retaining portion of the main body and adapted to retain the outer sheath.

13. The carburetor of claim 12 wherein the cable retainer is adjustably carried by the cable retaining portion.

14. The carburetor of claim 13 wherein the cable retainer includes a threaded portion and the cable retaining portion of the main body includes complementary threads for threaded receipt of the cable retainer.

15. The carburetor of claim 10 wherein the throttle valve lever includes a recess constructed to engage a portion of the inner cable to couple the inner cable to the throttle valve lever.

16. The carburetor of claim 10 wherein the throttle valve lever includes a groove constructed to receive a portion of the inner cable during at least a portion of the rotation of the throttle valve.

17. The carburetor of claim 10 wherein the valve bore has an axis and the cable retaining portion includes an engagement surface oriented in a predetermined location relative to the axis of the valve bore.

18. A method of forming a carburetor main body for a rotary throttle valve carburetor having a throttle valve with a valve body and a throttle valve shaft extending from the valve body out of the carburetor main body for attachment to a throttle cable operable to actuate the throttle valve, the method comprising the steps of:

providing a mold with a cavity for forming the carburetor main body;

providing a movable core movable into said mold cavity to define in the carburetor main body a valve bore having a partially obstructed first end defining a support portion, configured to receive therethrough a portion of the throttle valve shaft and an opposite end opening to the exterior of the carburetor main body through which the valve body can be inserted into the valve bore;

adding to said cavity defined in part by the core a flowable material from which the carburetor main body including the valve bore is to be formed; and permitting said flowable material to at least partially solidify while in the cavity to form the carburetor main body with the valve bore therein.

19. The method of claim 18 which also comprises the step of forming integrally with the carburetor main body a cable retaining portion adapted to retain a portion of a throttle cable that is used to actuate the throttle valve.

20. The method of claim 18 wherein the mold cavity is shaped to define the cable retaining portion integrally with the remainder of the carburetor main body.

* * * * *